United States Patent [19]

Koffer et al.

[11] 4,009,611

[45] Mar. 1, 1977

[54] HAND-HELD MICROPIPETTOR WITH IMPROVED PIPETTE TIP EJECTOR

[75] Inventors: George Warren Koffer, Los Altos; Doud Roger Branham, Redwood City, both of Calif.

[73] Assignee: Oxford Laboratories Inc., Foster City, Calif.

[22] Filed: May 13, 1976

[21] Appl. No.: 686,240

[52] U.S. Cl. ..... 73/425.6

[51] Int. Cl.[2] ..... B01L 3/02

[58] Field of Search ..... 73/425.4 P, 425.6; 141/21, 25, 26, 27

[56] References Cited

UNITED STATES PATENTS

| | | | |
|---|---|---|---|
| 3,766,785 | 10/1973 | Smernoff | 73/425.6 |
| 3,853,012 | 12/1974 | Scordato | 73/425.6 |
| 3,918,308 | 11/1975 | Reed | 73/425.6 |

*Primary Examiner*—S. Clement Swisher
*Attorney, Agent, or Firm*—Limbach, Limbach & Sutton

[57] ABSTRACT

A hand-held micropipettor having an improved tip ejector that is operable by the same thumb stroke of the user that operates a liquid transfer plunger therein. In one embodiment, the tip ejector has its own separate knob adjacent the liquid transfer plunger. In another embodiment, operation of the plunger itself causes a pipette tip to be ejected at the end of the liquid transfer plunger stroke.

5 Claims, 5 Drawing Figures

HAND-HELD MICROPIPETTOR WITH IMPROVED PIPETTE TIP EJECTOR

BACKGROUND OF THE INVENTION

This invention relates generally to liquid transfer devices, and more particularly to improvements in tip ejectors for hand-held micropipettors.

Within the last few years, hand-held micropipettors have become very popular as laboratory instruments, primarily in medical laboratories. The following United States patents describe existing instruments supplied by Oxford Laboratories Inc., the assignee of the present application: RE 27,637 — Roach (1973); 3,855,867 — Roach (1974); 3,882,729 — Roach (1975); and 3,918,308 — Reed (1975). Such devices include a tube-like barrel body structure having a plunger assembly extending outward of one end thereof terminating in a liquid transfer operating knob. A piston is attached to the other end of the plunger within a piston chamber. The piston chamber is maintained in fluid communication with an aperture at an end of the barrel handle which is shaped for frictionally engaging a detachable tip. The piston is held in a normal rest position by one or more springs within the barrel handle. When used to transfer liquid, the pipettor plunger is depressed, the attached tip is placed in a liquid and the plunger released to draw liquid into the tip. The pipettor is then removed to a container for discharge of the liquid. The liquid is discharged from the tip by again depressing the plunger.

After discharge, it is often desirable to remove the used plastic tip from the end of the micropipettor and dispose of it. A fresh tip is utilized for subsequent pipetting of different liquids in order to prevent cross-contamination. Rather than requiring the operator to force the tip off the micropipettor by manual pulling, some devices provide detipping mechanisms which are used by the operator to force a used tip off the micropipettor without having to touch the used pipette tip. Micropipettors with detipping devices are shown in the aforementioned U.S. Pat. No. 3,918,308 and also in additional U.S. Pat. Nos. 3,853,012 — Scordato (1974) and 3,766,785 — Smernoff (1973). Each of these patents describe a micropipettor that requires a separate hand operation to remove pipette tips therefrom that is in addition to the hand operations required to transfer liquid with the device. It is a principal object of the present invention to provide a tip ejecting structure for a hand-held micropipettor that is operable as part of the same hand manipulation which occurs during liquid transfer.

SUMMARY OF THE INVENTION

Briefly and generally, the present invention includes the provision of a tip ejecting sleeve operating member terminating at an upper end of the micropipettor adjacent the liquid transfer plunger operating knob. In one form, the tip ejecting operating member terminates in a knob that is independently depressed by the operator but which is positioned to be easily and naturally depressed by the operator's thumb immediately after completing a liquid transfer operation. In another embodiment, the termination of the tip ejecting operating member is positioned immediately below the liquid transfer knob so that the tip ejector mechanism is operated in response to an extra depression of the liquid transfer knob after discharge of liquid being transferred and in a single plunger stroke.

This tip ejecting mechanism does not require the operator to use a second hand in order to accomplish the ejection. No enabling operation, such as a rotation of the liquid transfer plunger knob, is necessary. Nor is a separate gripping of the tip ejector sleeve by the second free hand of the operator required.

Additional objects, advantages and features of the present invention will become clear from the following detailed description which should be taken in conjunction with the accompanying drawings.

DESCRIPTION OF THE PREFERRED EMBODIMENTS

Figure 1:
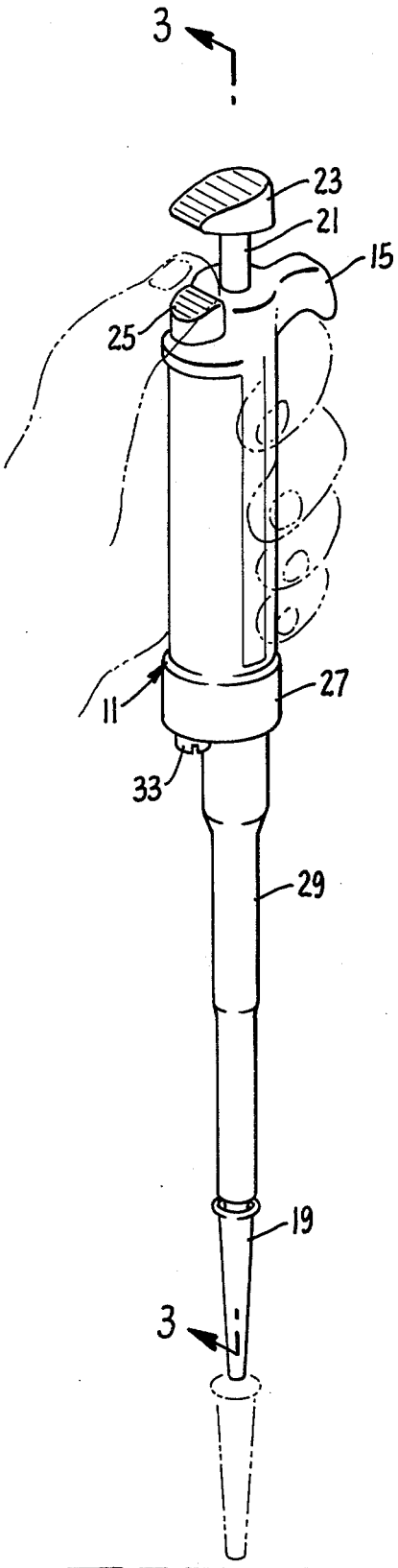
FIG. 1 shows a hand-held micropipettor employing a tip ejector with its own operable knob.
Figure 2:
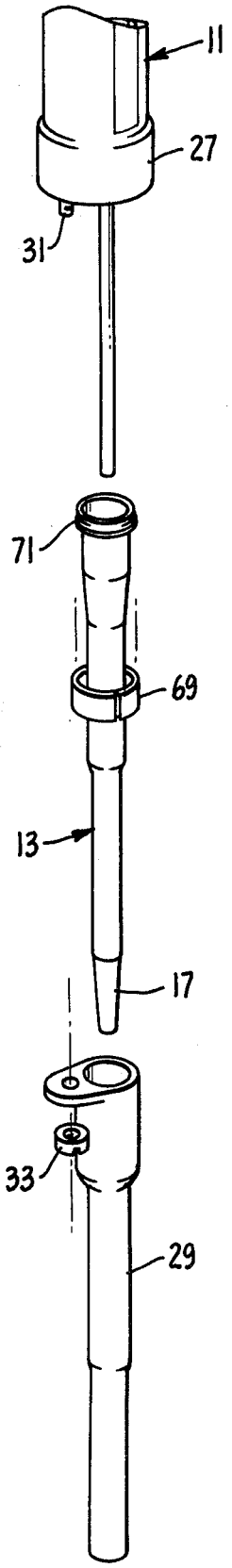
FIG. 2 is an exploded view of the major components of the micropipettor of FIG. 1.
Figure 3:
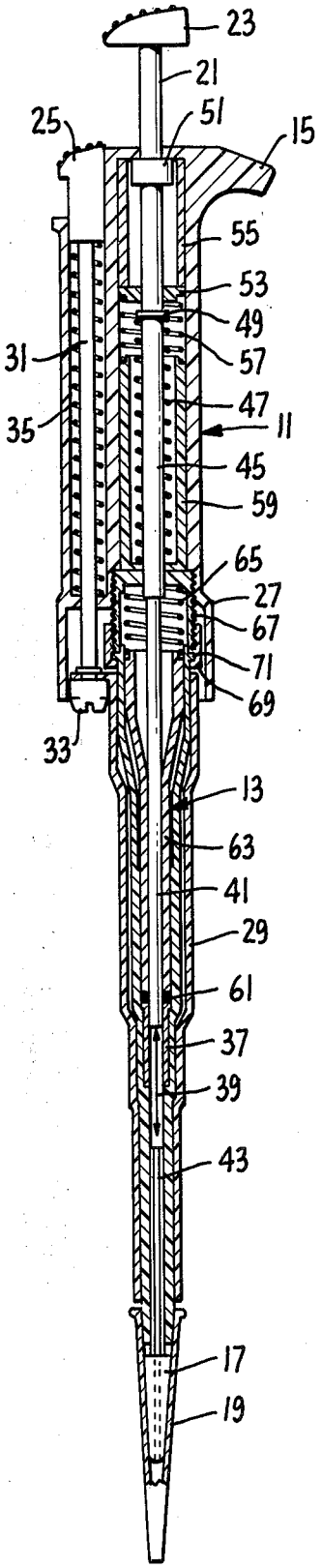
FIG. 3 is a cross-sectional view of the micropipettor of FIG. 1 taken across section 3—3 thereof.

Referring initially to FIGS. 1–3, the micropipettor body includes an upper barrel handle portion 11 having a lower barrel portion 13 threadedly attached thereto at one end thereof. At an opposite free end of the barrel handle 11, a finger hold 15 protrudes radially out from the generally cylindrical member 11. A free end 17 of the lower barrel portion 13 is conically shaped for frictionally engaging the interior of a disposable plastic pipette tip 19.

Extending outward of the free end of the barrel handle is a plunger 21 that is slidable into and out of that end of the barrel handle. Attached to the free end of the plunger 21 is a liquid transfer knob 23. Immediately adjacent the free end of the barrel handle is a separate tip ejector knob 25 that is provided on a side of the plunger 21 opposite to that of the finger hold 15. At the end of the barrel handle 11 to which the lower barrel 13 is attached, an enlarged diameter flange 27 is provided. The length of the barrel handle 11 between the finger hold 15 and the flange 27 is of substantially the same cross-sectional shape and adapted in length to receive the operator's fingers in a manner illustrated in dashed outline in FIG. 1. The operator's thumb is bent in a position to selectively operate each of the liquid transfer knob 23 and tip ejector knob 25.

The tip ejecting mechanism operably connected to the knob 25 includes a tip ejector sleeve 29 that is slidable in an axial direction along the length of the lower barrel 13 which it surrounds. The tip ejecting sleeve 29 is connected to the knob 25 by a tip ejector coupling rod 31 and an appropriate threaded nut 33 engaging one end of the rod 31. The opposite end of the rod 31 is preferably molded into the knob 25. A spring 35 captured within the barrel handle member 11 holds the tip retaining sleeve in a normal position as shown in FIG. 3 wherein it does not interfere with the tip 19 until the knob 25 is depressed a sufficient distance against the force of the spring 35.

When the operator has completed a liquid transfer operation using the instrument shown in FIGS. 1–3, the operator then presses the knob 25 which causes the sleeve 29 to move a distance along the lower barrel 13 sufficient to push off the tip 19. The operator does this without moving his or her fingers that are gripping the barrel handle 11, and without having to use another hand to actuate the tip removal structure. Furthermore, no separate "unlocking" operation is required to place the tip ejector mechanism into a state where it can be operated. The tip ejector sleeve 29 responds axially against a tip 19 solely by depressing the button 25 a sufficient axial distance.

A sleeve 37 is provided within the lower barrel 13 and forms a portion of a piston chamber 39. A piston 41 operably moves back and forth over the distance shown by the arrow in FIG. 3 as the instrument is used for its liquid transfer function. At an opposite end of the piston chamber 39 from that into which the piston 41 extends, a fluid path 43 extends from the piston chamber 39 through the barrel 13 and its tip 17. This passage provides a fluid communication between the piston chamber and the interior of the detachable tip 19. In normal use, liquid being pipetted by the device is not drawn into the passage 43 at all but rather the liquid remains in the detachable tip 19. Thus, there remains an air interface between the liquid being pipetted in the tip 19 and the piston 41.

The piston 41 is operably connected to the liquid transfer knob 23 through a plunger assembly including the plunger element 21 and a piston rod extender 45. The entire assembly of the piston 41 and the plunger assembly elements 21 and 45 move axially along the length of the micropipettor by an operator through the knob 23. The normal position of this assembly is that shown in FIG. 3 wherein a spring element 47 is fixed at one end to the extender rod 45 by some appropriate ring or pin 49. When used for pipetting liquids, the operator depresses the knob 23 against the force of the spring 47 until a primary stop 51, rigidly attached to the rod 45, strikes a plunger stop 53 provided as a closed end to a cylindrical calibration sleeve 55. The distance between the rest position shown in FIG. 3 and the position wherein the stop 51 abuts the stop 53 is the normal calibrated liquid transfer distance. The volume of liquid transferred by the device is thus controlled by the length of the calibration sleeve 55.

When the operator further depresses the knob 23 while the stop 51 is abutted against the stop 53, the calibration sleeve 55 and its stop 53 will move within the barrel handle 11 against the force of a secondary spring 57. The secondary spring 57 is made to be much stronger than the primary spring 47 so that the operator will know by differences in force required when the secondary spring 57 is encountered. The spring 57 is held in place between one side of the plunger stop 53 and a secondary spring retainer 59.

In a forward mode operation, only the primary spring 47 is utilized when drawing liquid into the pipette tip 19 while upon discharge of liquid from the tip 19 the operator depresses the knob 23 in a manner to compress the secondary spring 57 as well. This latter operation is sometimes referred to as an "an overshoot operation of a piston. The purpose of such and overshoot is to make sure that all liquid that might be attached to the side walls of the interior of the tip 19 is displaced therefrom.

In a reverse mode operation, both the primary spring 47 and the secondary spring 57 are initially compressed prior to drawing liquid into the tip 19. The piston assembly is then allowed to return to its rest position. For discharge of the calibrated volume of liquid from the tip 19, the knob 23 is depressed against the primary spring 47 only. The secondary spring 57 is not compressed.

The piston 41 is sealed to the piston chamber 79 by a compressible O-shaped seal 61 which surrounds and contacts the piston 41. The seal 61 is held in axial position by fixedly abutting up against one end of the piston chamber forming sleeve 37. A seal retainer 63 is provided with one end thereof urged against the opposite side of the seal 61 by a piston seal compressor spring 65. The retainer 63 is held loosely about the piston 41 and is slidable in an axial direction within the lower barrel portion 29 except for the influence of the spring 65. The spring 65 is maintained in a constant state of compression no matter what position the piston 41.

The lower barrel portion 13 is attached to the handle barrel portion 11 by means of an adapter 67 and a coupling nut 69. The adapter is threaded on the outside with mating threads being provided on the inside of the barrel handle member 11 adjacent an edge of the outward flange 27. The coupling nut 69 engages a lip 71 annually extending around the end of the lower barrel portion 13 and clamps it up against the mating underside of the adapter 67.

Figure 4:
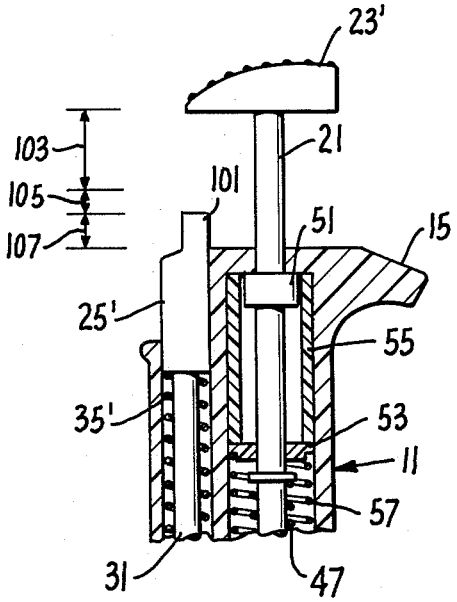
FIG. 4 illustrates a modification of the micropipettor of FIGS. 1–3, wherein the tip ejector is operated at the end of a liquid discharge plunger stroke without a separate operable knob therefore.

FIG. 4 illustrates a portion of the micropipettor of FIGS. 1–3 with certain modifications thereto. For the components and parts of the micropipettor of FIG. 4 that are identical to those of the embodiment of FIGS. 1–3, the same reference numberals are used. For parts and components that are altered somewhat, however, a prime (') is added to the reference numeral used for a corresponding part of the embodiment of FIGS. 1–3.

The principal change in FIG. 4 is a substitution of a differently shaped liquid transfer knob 23' and a modified tip ejector knob 25'. The change in shape permits a cooperation between the knobs 23' and 25' so that the micropipettor operator does not need to press a separate button to eject the tip 19 after completion of pipetting. The tip ejector knob 25' has a raised segment 101 that is positioned to be contacted by the underside of the liquid transfer knob 23' when that knob is depressed fully against the upper edge of the barrel handle 11. The portion 101 of the knob 25' extends outward of the end portion of the barrel handle for engagement with the knob 23'.

The operation of the micropipettor modification illustrated in FIG. 4 may be observed with reference to the illustrative arrows 103, 105 and 107 on FIG. 4. The primary stroke of the micropipettor is illustrated by the arrow 103 which is the distance through which the underside of the knob 23' travels to cause the primary stop 51 to just strike the plunger stop 53 within the micropipettor. Further depression of the knob 23' through the distance indicated by the arrow 105 is the overshoot distance wherein the secondary spring 57 is compressed as well. The third segment indicated by the arrow 107 occurs after the knob 23' and its associated plunger assembly has been driven through the overshoot segment. As the knob 23' travels through the distance marked by the arrow 107, it pushes upon the extension 101 of the tip ejecting knob 25' and thus ejects the tip 19 from the opposite end of the micropipettor.

The result of the modification of FIG. 4 is that a single axial stroke of the knob 23' by the operator accomplishes both the primary and secondary liquid piston movements as well as the tip ejecting feature. The operator is made aware of when one portion of the operating cycle ends and the other begins by the spring elements having a different strength. The fact that the force exerted against the knob 23' to return it to its upward position is greater in the overshoot segment 105 of the stroke than it is in the primary portion 103 of the stroke has been discussed above with respect to the embodiment of FIGS. 1–3. So that operator does not accidentaly eject the tip when he or she does not desire to, the tip ejecting mechanism return spring 35' is made to be very stiff. In the previously described embodiment of FIGS. 1–3, the tip ejecting mechanism return spring 35 may be a very light one.

A modification of tip ejection mechanism of FIG. 4 would be to include side extension on plunger 21 inside the barrel handle 11 which would actuate the ejector coupling rod 31. The tip ejector knob 25' would not be needed since the actuation of the ejector coupling rod would be within the handle 11.

Figure 5:
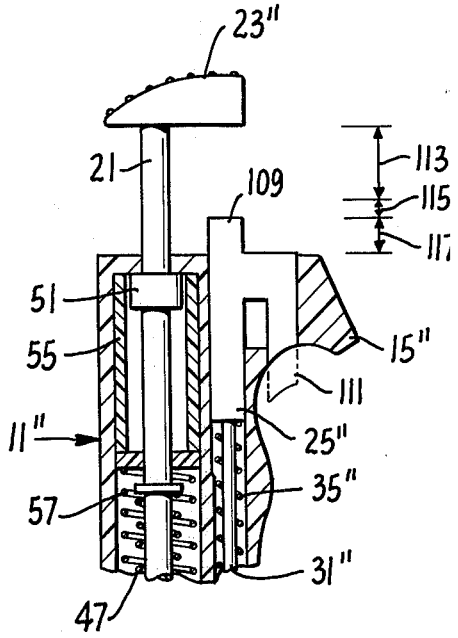
FIG. 5 illustrates a modification of the embodiment of FIG. 4.

Referring to FIG. 5, yet another modification is shown with different shaped parts corresponding to those of the embodiment of FIGS. 1–3 being given the same reference character but with a double prime (") added thereto. The principal additional feature of the FIG. 5 modification is the provision of a segment 111 added to the underside of the tip ejecting knob 25" which engages the micropipettor's finger in order to prevent unintended tip ejection. The operator's forefinger would normally grip the micropipettor barrel handle 11" with a forefinger immediately under the finger hold 15". This makes it necessary for the operator to consciously roll his or her finger away from the underside of the finger hold 15' when the tip ejector function is desired to take place. This embodiment still requires no separate enabling action in order to eject a tip from the micropipettor except for a slight roll of the operator's forefinger as described. In order to maintain the forefinger immediately adjacent the underside of the finger hold 15", the barrel handle 11" is provided with undulations on the side of the finger hold 15" as shown in FIG. 5. The undulation immediately under the finger hold 15" holds the operator's forefinger in the desired normal position.

In FIG. 5, the tip ejecting knob 25" has a portion 109 that extends beyond the end of the barrel handle 11" for engagement with the underside of the liquid transfer knob 23". The primary liquid transfer stroke is indicated by the arrow 113, the overshoot stroke by the arrow 115 and the tip ejecting portion of the stroke by the arrow 117. The tip ejecting knob 25" and shaft 31" are provided on the same side of the plunger 21 within the barrel handle 11" as the finger hold 15". The tip ejector mechanism return spring 35" may be a lighter strength spring than is desired for the spring 35' of the FIG. 4 embodiment. In the FIG. 5 embodiment, the spring 35" does not serve as the exclusive means to give a micropipettor operator a feel of when the tip ejector is operating. The extension 111 of the knob 25" that contacts the operator's forefinger provides this indication.

The present invention has been described with respect to several specific embodiments but it will be understood that the invention is entitled to protection within the full scope of the appended claims.

We claim:

1. In a hand-held micropipettor, comprising:
an elongated body having one defined end,
a piston chamber within said body oriented along the length of said body,
a piston within said piston chamber and adapted to move back and forth in an axial direction of said elongated body,
means extending from said piston out of said one defined end of said body to a first knob for providing such reciprocal motion to said piston by depression of said first knob,
a resilient element normally urging said first knob outward away from said one defined end of the body, another end of said body being adapted to frictionally engage the interior of a detachable plastic tip,
a tip ejecting sleeve surrounding at least a portion of said body adjacent its said tip holding end and operable in an axial direction along the body between a normal position that does not interfere with the attachment of a tip to said another end and a tip ejecting position which forces a tip from said another end of the body, and
a resilient means operably connected between said ejecting sleeve and said body for urging said sleeve toward its said first position absent manual operation thereof, the improvement comprising:
a second knob body positioned at said one defined body end and adjacent said first knob, and
means connecting said second knob and said tip ejecting sleeve for operating said sleeve to its said second position upon an axial movement of said second knob in a direction toward said tip engaging end of the body.

2. The improved micropipettor of claim 1 wherein said second knob is laterally displaced from said first knob so that the knobs do not engage each other, and further wherein said second knob and said means connecting the second knob to the ejecting sleeve are operable to eject a tip in a manner wholly independent of the operation of said first knob and said piston.

3. The improved micropipettor of claim 1 wherein said second knob is positioned to be engaged and depressed by the first knob being activated to its fullest position against said one defined end of the micropipettor body, whereby the tip ejecting sleeve operates as part of the liquid transfer piston assembly movement.

4. The improved micropipettor of claim 3 which additionally comprises:
a finger hold extending generally radially outward of said micropipettor body at said one defined end,
means including undulations along the side of the micropipettor for holding an operator's hand at a desired position along the length of the micropipettor body immediately below said finger hold, and
means operably connected to said second knob for urging upon depression of said knob a portion thereof into space immediately below said finger hold wherein the operator's forefinger is to be positioned, whereby the tip ejection is not activated absent a movement of the operator's forefinger.

5. A hand-held micropipettor, comprising:
an elongated micropipettor body having an upper end and a lower end, said lower end being shaped for frictionally engaging the interior of a detachable pipette tip, a piston chamber aligned within said body in an axial direction, a piston entering an upper end of said piston chamber in a manner to be axially reciprocal therein, means extending from said piston out of said upper end of said body to a knob for providing such reciprocal motion to said piston over at least a defined liquid transfer range, resilient means for normally positioning said piston and said knob in an extreme upper position, means within said body for establishing fluid communication between said piston chamber and the interior of a tip engaged by said lower end, means within said micropipettor body for defining a stroke distance of said piston for liquid transfer thereby, a tip ejector sleeve surrounding at least a portion of the pipettor body adjacent said tip holding end and operable in an axial direction therealong between a normal position wherein a tip is not affected and a tip ejecting position wherein said sleeve forces a tip off of the end of the pipettor, means operably connected to said sleeve for normally urging said tip ejecting sleeve to its said normal position, and means movable solely in an axial direction for moving said sleeve to its tip ejecting position in response to said knob being depressed axially beyond its said defined liquid transfer range toward the upper end of said micropipettor barrel, no other motion having to be applied by an operator in order to effect said sleeve movement.

* * * * *

Disclaimer 4,009,611.—*George Warren Koffer*, Los Altos, and *Doud Roger Branham*, Redwood City, Calif. HAND-HELD MICROPIPETTOR WITH IMPROVED PIPETTE TIP EJECTOR. Patent dated Mar. 1, 1977. Disclaimer filed July 3, 1978, by the assignee, *Oxford Laboratories Inc.*

Hereby enters this disclaimer to claims 1 and 2 of said patent.

[*Official Gazette September 5, 1978.*]